US006326060B1

(12) United States Patent
Ogawa

(10) Patent No.: US 6,326,060 B1
(45) Date of Patent: Dec. 4, 2001

(54) METHOD OF FORMING COATING LAYERS

(75) Inventor: Shotaro Ogawa, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/640,374

(22) Filed: Aug. 17, 2000

(30) Foreign Application Priority Data

Aug. 17, 1999 (JP) ..... 11-230669

(51) Int. Cl.[7] ..... B05D 3/02

(52) U.S. Cl. ..... 427/382; 427/391; 162/135; 162/136

(58) Field of Search ..... 427/381, 382; 162/135, 136

(56) References Cited

U.S. PATENT DOCUMENTS 3,941,728 * 3/1976 Solenberger .
5,494,509 * 2/1996 Kruythoff et al. ..... 106/197.1

FOREIGN PATENT DOCUMENTS

2510919 * 9/1975 (DE) .
5-1198 1/1993 (JP) .
6-67330 3/1994 (JP) .
6-75318 3/1994 (JP) .
6-81297 3/1994 (JP) .
7-18599 1/1995 (JP) .
7-120880 5/1995 (JP) .
8-272014 10/1996 (JP) .
9-164758 6/1997 (JP) .
10-325097 * 12/1998 (JP) .

OTHER PUBLICATIONS

English language abstract JP 09164758A Jun. 24, 1997.
English language abstract JP 06067330A Mar. 11, 1994.
English language abstract JP 06075318A Mar. 18, 1994.
English language abstract JP 07120880A May 12, 1995.
English language abstract JP 08272014A Oct. 18, 1996.
English language abstract JP 06081297A Mar. 22, 1994.
English language abstract JP 5–1198(A) Jan. 8, 1993.
English language abstract JP 07018599A Jan. 20, 1995.

* cited by examiner

*Primary Examiner*—Erma Cameron
(74) *Attorney, Agent, or Firm*—Sughrue, Mion, Zinn, Macpeak & Seas, PLLC

(57) ABSTRACT

Polymer polysaccharide is added to a PVA coating liquid so that a density of the polymer polysaccharide is within the range between 0.05% and 0.5% by weight with respect to the PVA coating liquid. Next, a coating liquid layer is formed on a web by coating the web with the PVA coating liquid to which the polymer polysaccharide is added so that a temperature of the PVA coating liquid is within the range between 20° C. and 40° C. at the coating. Then, the coating liquid layer on the web is dried after it is preliminarily dried so that a temperature of the coating liquid layer is maintained at a temperature that is 3° C. lower than the temperature of the PVA coating liquid or lower for three seconds or more.

11 Claims, 4 Drawing Sheets

FIG. 4

| | COATING LIQUIDS | POLYSACCHARIDE DENSITIES | METAL ION ADDING AMOUNTS | VISCOSITIES (28°C) [TOP LAYER/ BOTTOM LAYER] | VISCOSITIES (20°C) [TOP LAYER/ BOTTOM LAYER] | DRYING CONDITIONS | LAYER FORMING AT COATING | LAYER FORMING AFTER DRYING | COLORING SENSITIVITIES | WEATHER-ABILITIES | QUALITIES OF PRODUCTS |
|---|---|---|---|---|---|---|---|---|---|---|---|
| EMBODIMENT (1) | a | 0. 4 | 0 | 60/80 | 1400/1600 | A | GOOD | GOOD | GOOD | GOOD | GOOD |
| EMBODIMENT (2) | a | 0. 3 | 0.005 | 80/120 | 3400/4600 | A | GOOD | EXCELLENT | GOOD | GOOD | GOOD |
| EMBODIMENT (3) | a | 0. 3 | 0.010 | 110/140 | 5400/7600 | A | GOOD | EXCELLENT | GOOD | GOOD | GOOD |
| REFERENCE (1) | a | 0. 4 | 0 | 70/90 | 1400/1600 | B | GOOD | BAD | POOR | POOR | BAD |
| REFERENCE (2) | a | 0. 04 | 0 | 60/80 | 200/250 | A | GOOD | BAD | POOR | POOR | BAD |
| REFERENCE (3) | a | 0. 6 | 0 | 260/330 | 8000/22000 | A | BAD | ---------- | ---------- | ---------- | ---------- |
| REFERENCE (4) | a | 0. 3 | 0.030 | 180/220 | 6400/9600 | A | BAD | ---------- | ---------- | ---------- | ---------- |
| REFERENCE (5) | a | 0. 4 | 0 | 60/80 | 1400/1600 | C | GOOD | POOR | GOOD | POOR | POOR |
| REFERENCE (6) | b | 0. 4 | 0 | 50/60 | 300/350 | A | GOOD | POOR | GOOD | POOR | POOR |
| REFERENCE (7) | c | 0. 4 | 0 | 35/40 | 250/300 | A | GOOD | POOR | GOOD | POOR | POOR |

METHOD OF FORMING COATING LAYERS

BACKGROUND OF THE INVENTION

1. Field of the Invention

The present invention relates generally to a method of forming coating layers, and more particularly to a method of forming coating layers in which a continuously-running web is coated with multiple PVA coating liquids containing polyvinyl alcohol (PVA) and then the coating liquid layers on the web is dried to form coating layers in the manufacture of heat-sensitive recording paper, pressure-sensitive recording paper, printing plates, or the like.

2. Description of Related Art

PVA is used as a hydrophilic binder when a web is coated with a chemical, and is used for maintaining barrier and surface strength, and the like.

However, it is difficult to stably coat the web with a PVA coating liquid containing PVA with uniform thickness, and it is difficult to form a coating layer with a uniform thickness (uniform drying) by stably and quickly drying the coating liquid layer on the web without making the coating liquid layer rough. This is because the PVA coating liquid does not have property of stabilizing the coating liquid layer by turning into gel at a low temperature like a gelatin solution, and the coating liquid layer gets rough due to a drying wind at the drying and the uniform drying can not be easily performed. In case the web is coated with multiple PVA coating liquids, the interfaces between the layers easily get rough due to the drying wind and be mixed, and thus the uniform drying can not be easily performed. Therefore, the quality of the product is low.

The viscosity of the PVA coating liquid may be raised to prevent the coating liquid layer from getting rough due to the drying wind. But, the stable coating can not be performed when the viscosity is high at the coating even though the coating liquid layer does not get rough if the viscosity is high. Meanwhile, if the viscosity of the PVA coating liquid is adjusted for the coating, the viscosity is so low at the drying that the uniform drying can not be performed. Since the conditions for the stable coating and the uniform drying are directly opposed by each other, it is difficult to satisfy both of them.

A variety of measures has been taken to achieve the stable coating and the uniform drying of the PVA coating liquid.

Japanese Patent Provisional Publication No. 9-164758 discloses a production of ink-jet recording paper comprising the step of adding carrageenan to a PVA coating liquid, and the step of adding 10 millimoles of metal ions or more with respect to a liter of the coating liquid and the step of cooling the PVA coating liquid by lowering the temperature of the PVA coating liquid to the temperature that is 5° C. lower than that at the coating or lower. Japanese Patent Provisional Publication No. 6-67330 discloses a production of photographic material in which 10 millimoles of polysaccharide or more are added with respect to a liter of the coating liquid. Japanese Patent Provisional Publication No. 6-75318 discloses silver halide emulsion including natural polymer red algae polysaccharide (such as carrageenan). Japanese Patent Provisional Publication No. 7-120880 discloses a production of a photographic support in which there are multiple layers including a layer that has polysaccharide that turns into gel when it is cooled. Japanese Patent Provisional Publication No. 8-272014 discloses a production of photographic material in which the web passes a cooling zone that includes red algae polysaccharide and whose temperature is lower than the temperatures of set points of the layers. Japanese Patent Provisional Publication No. 6-81297 discloses that carboxymethel starch, water soluble cellulose or marine algae polysaccharide is added to PVA to improve the coating for paper. Japanese Patent Provisional Publication No. 5-1198 discloses water soluble film composed of PVA to which polysaccharide is added so that the density of the polysaccharide is within the range between 1 and 40% with respect to PVA. Japanese Patent Provisional Publication No. 7-18599 discloses that PVA density and coating temperature are extremely high. The PVA density is within the range between 12 and 60%, and the coating temperature is within the range between 60 and 95° C.

However, the above technics are not good enough for the stable coating and the uniform drying, especially for the uniform drying.

Polysaccharide is added to the PVA coating liquid to give the PVA coating liquid property of turning into gel at a low temperature, but effective property can not always be obtained when polysaccharide is added.

Also, the web is coated with a PVA coating liquid containing polysaccharide at a high temperature, and then the viscosity of the PVA coating liquid is raised with a cold wind to satisfy both the stable coating and the uniform drying. It does not solve the problem since it requires a heat-retaining device for the coating liquid and a product such as a heat-sensitive recording material receives a bad influence from high temperature.

Enough conditions for satisfying both the stable coating and the uniform drying have not been determined, and it is important to determine the conditions.

SUMMARY OF THE INVENTION

In view of the foregoing, it is an object of the present invention to provide a method of forming PVA coating layers where stable coating and uniform drying of PVA coating liquids can be achieved and coating liquid layers that are not rough and have uniform thicknesses can be formed.

To achieve the above-mentioned object, the present invention is directed to a method of forming a coating layer where a running web is coated with a PVA coating liquid containing polyvinyl alcohol and a coating liquid layer on the running web is dried to form the coating layer on the running web, the method comprising the steps of: adding polymer polysaccharide to the PVA coating liquid so that a density of the polymer polysaccharide is within the range between 0.05% and 0.5% by weight with respect to the PVA coating liquid; forming the coating liquid layer on the running web by coating the running web with the PVA coating liquid to which the polymer polysaccharide is added so that a temperature of the PVA coating liquid is within the range between 20° C. and 40° C. at the coating; and drying the coating liquid layer after preliminarily drying the coating liquid layer on the running web so that a temperature of the coating liquid layer is maintained for at least three seconds at a temperature that is lower than the temperature of the PVA coating liquid by at least 3° C.

According to the present invention, the adding condition of the polymer polysaccharide for the coating liquid containing PVA, the temperature of the coating liquid at the coating and the condition for the preliminary drying before the drying are appropriately determined. Thus, both the stable coating and the uniform drying of the PVA coating liquid can be achieved. Therefore, the coating layer that is not rough and has a uniform thickness, and the quality of the product can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 4 is a table showing an embodiment of the method of forming the coating layers according to the present invention.

DETAILED DESCRIPTION OF THE PREFERRED EMBODIMENT

This invention will be described in further detail by way of example with reference to the accompanying drawings.

Figure 1:
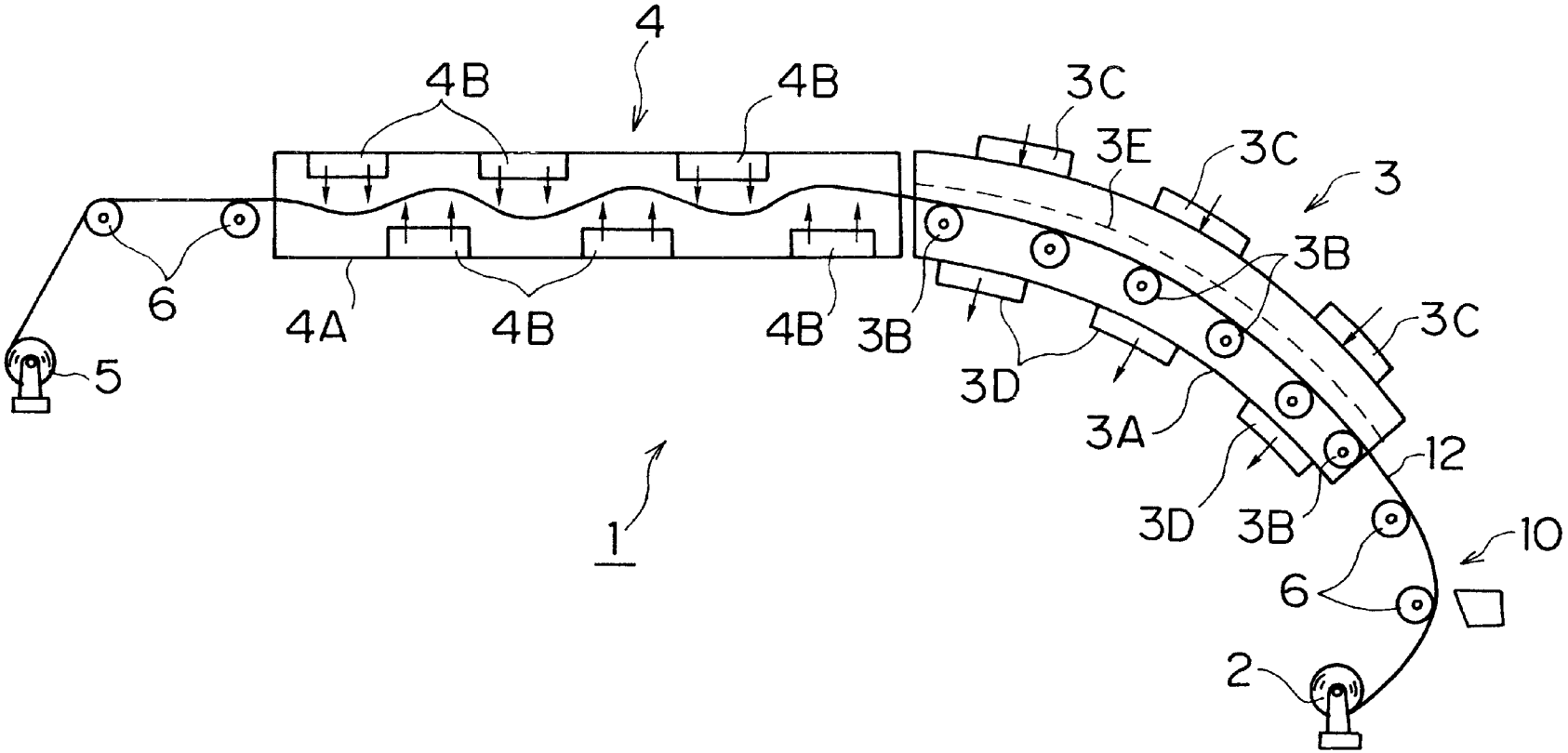
FIG. 1 is a drawing showing the structure of a coating and drying line to which a method of forming coating layers according to the present invention is applied.
Figure 2:
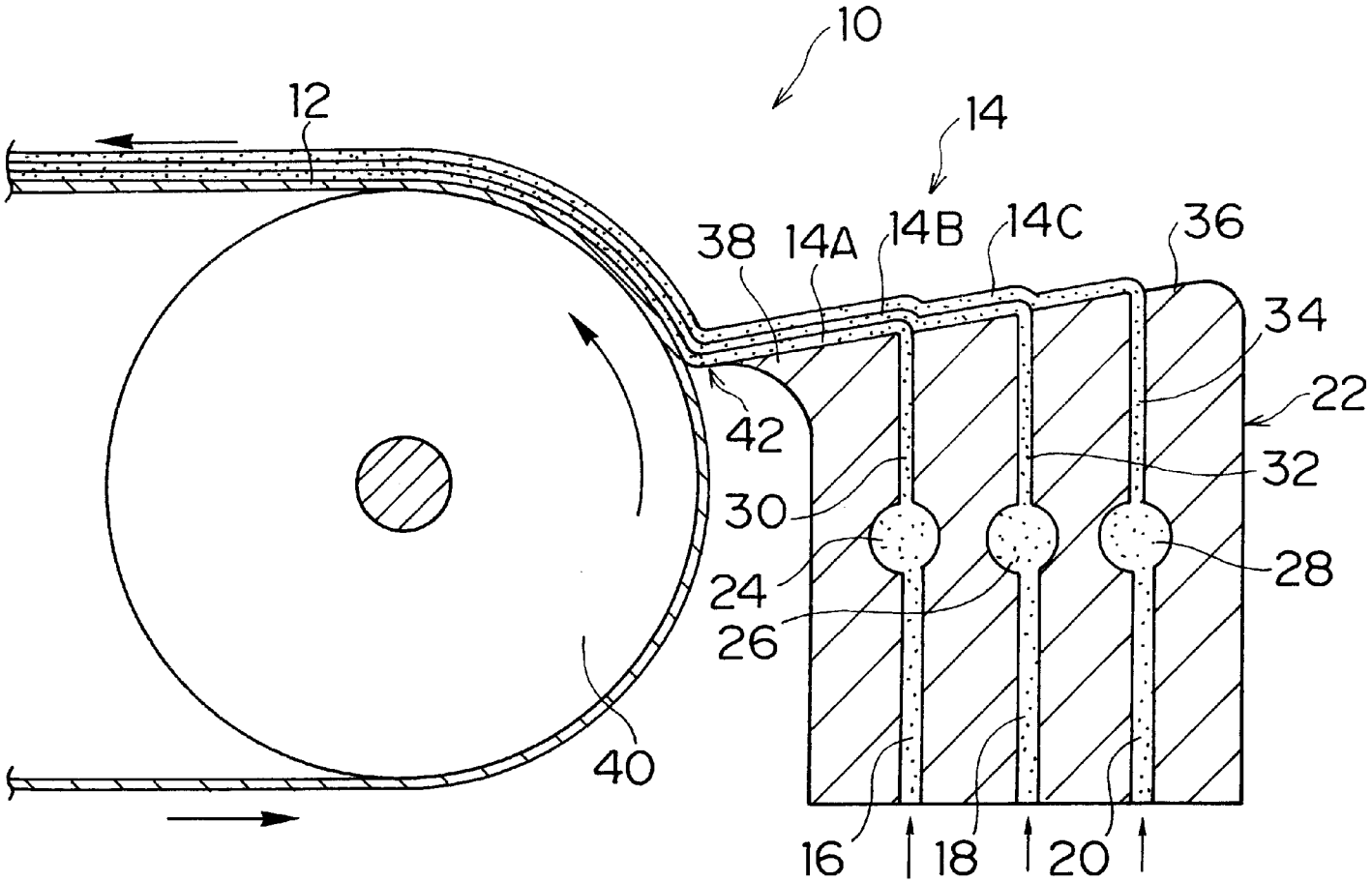
FIG. 2 is a sectional view showing a coating apparatus of the coating and drying line.

FIG. 1 is a drawing showing the structure of a coating and drying line 1 to which a method of forming coating layers according to the present invention is applied. FIG. 2 is a sectional view showing a coating apparatus 10 of the coating and drying line 1 in FIG. 1.

As shown in FIG. 1, the coating and drying line 1 comprises a feeding device 2 that feeds a web 12 wound as a roll, the coating apparatus 10 that coats the web 12 with PVA coating liquids 14, a light wind drying device 3 that preliminarily dries the PVA coating liquids 14 coated on the web 12, a strong wind drying device 4 that finally dries the PVA coating liquids 14 after the preliminary drying, a winding device 5 that winds the web 12 after the final drying, and a plurality of path rollers 6 that forms a running path for the web 12.

As shown in FIG. 2, the coating apparatus 10 has a slide hopper 22 and coats the web 12 with three types of coating liquids 14 at one time. The multiple layer types (e.g., three layers) of coating liquids 14 to be coated on the surface of the web 12 are supplied to manifolds 24, 26, 28 in a slide hopper 22 through supply lines 16, 18, 20, respectively. The PVA coating liquids 14 supplied to the manifolds 24, 26, 28 are expanded in a coating width direction, and then they are pressed onto an inclined slide surface 36 through slit-shaped slots 30, 32, 34, respectively. The PVA coating liquids 14 pressed onto the slide surface 36 form multiple layers without mixing with one another to flow along the slide surface 36, and reach a lip end 38 that is the bottom end of the slide surface 36. The PVA coating liquids 14 that reach the lip end 38 form a bead part 42 at the gap between the lip end 38 and the surface of the web 12 running while being wound on a backing roller 40. In this case, the pressure of the part below the bead part 42 is reduced to stabilize the bead part 42. At the bead part 42, the web 12 runs upward along the surface of the backing roller 40. Thus, the PVA coating liquids 14 are pulled onto the surface of the web 12 and expanded to become thinner. Consequently, the thin multiple layers are formed on the surface of the running web 12. The thickness of the multiple layers depends on the running speed of the web 12. In FIG. 2, the reference numeral 14A denotes the PVA coating liquid that forms the bottom layer of the multiple layers, and the reference numeral 14B denotes the PVA coating liquid that forms the middle layer, and the reference numeral 14C denotes the PVA coating liquid that forms the top layer.

Figure 3:
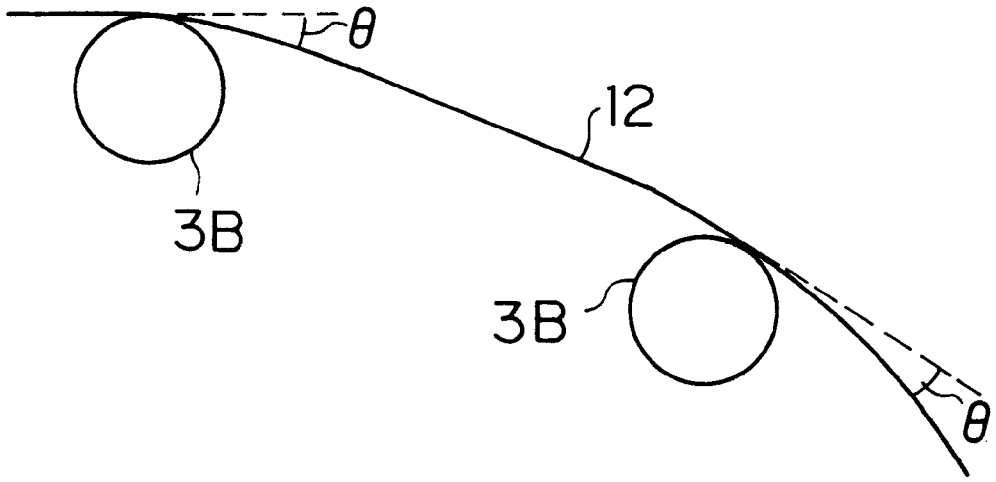
FIG. 3 is a diagram showing the relationship between path rollers and a web in a light wind drying device for preliminary drying.

As shown in FIG. 1, the light wind drying device 3 has a plurality of path rollers 3B arranged along an arch-shaped path for the web 12 in a tunnel-shaped body 3A whose entrance and exit are open (see FIG. 3). The path rollers 3B are arranged along the arch-shaped path to enlarge the contact areas of the path rollers 3B and the web 12 due to the turning angles (θ) of the web 12 at the path rollers 3B so that the web 12 is stably transferred. Thus, the web 12 stably runs during the preliminary drying, and therefore the surface of the layers does not get rough due to the running of the web 12. The web 12 is transferred the side that the coating apparatus 10 coats with the PVA coating liquids 14 up on the path rollers 3B. Supply holes 3C for supplying air into the body 3A are formed on the top of the body 3A, and suction holes 3D for sucking the air from the body 3A are formed on the bottom of the body 3A. A cold wind whose dew point is 15° C. or lower is supplied from the supply holes 3C through slits 3E while the air in the body 3A is sucked from the suction holes 3D, so that a cold wind flows onto the coating liquid layers on the web 12 at the speed of 1–8 m/sec.

The lower the temperature of the supplied cold wind is, the better; but it is restricted due to the performance of the facility. It is determined so that the temperature of the coating liquid layers on the web 12 can be maintained at the temperature that is 3° C. lower than that of the coating liquids when the coating apparatus 10 coats the web 12 with the coating liquids or lower for three seconds or more.

The strong wind drying device 4 is a device of the so-called air floating drier type, and it has a plurality of air headers 4B for giving out dry air that are arranged along the running path for the web 12 in a tunnel-shaped body 4A whose entrance and exit are open. The air headers 4B are alternately arranged above and below the web 12. A warm wind that is enough for quickly drying the coating liquid layers on the web 12 is given out of the air headers 4B at an enough speed for floating the web 12.

The temperature of the warm wind given out of the air headers 4B is preferably within the range between 25° C. and 40° C. so that the coating liquid layers can be quickly dried without lowering their viscosities. Thus, the web 12 runs meandering through the body 4A while being noncontact-supported while the coating liquid layers are quickly dried.

The method of forming the coating layers in the above-described coating and drying line 1 will now be explained.

Before the coating apparatus 10 coats the web 12 with the PVA coating liquids 14 and dries the coating liquid layers, the PVA coating liquids 14 satisfying conditions for stable coating and uniform drying are prepared.

First, addition agent is added to the PVA coating liquids 14. Polymer polysaccharide is added as the addition agent so that the densities of the addition agent are within the range between 0.05% and 0.5% by weight with respect to the PVA coating liquids 14 to make low-temperature gelation easier. If the densities of the addition agent were lower than 0.05% by weight, the addition agent would not be effective and the coating liquid layers would get rough during the drying. If the densities of the addition agent were higher than 0.5% by weight, the viscosities of the PVA coating liquids 14 would be too high and the viscosities would be unstable due to partial gelation of the PVA coating liquids 14, and thus unevenness occurs during the coating. Therefore, the stable coating would not be able to be performed. A variety of polymer polysaccharide may be used as the addition agent, and it is preferable natural polymer marine algae polysaccharidc such as K-carrageenan included in red algae.

If metal ions are added as well as the polymer polysaccharide, it makes the low-temperature gelation easier. But, if too many metal ions are added, the viscosities of the PVA coating liquids 14 are too high and the viscosities are unstable due to partial gelation of the PVA coating liquids 14 in the same way as in the case where too much polymer polysaccharide is added. Thus, the metal ions are preferably added so that 0.02 mol or less is included in a liter of coating liquids. It is more preferable to add the metal ions so that 0.015 mol or less is included in a liter of coating liquids. A variety of metal ions of potassium sulfate, potassium chloride, aluminum sulfate or the like may be used as the metal ions.

Also, it is preferable to satisfy the conditions that the densities of the PVA contained in the PVA coating liquids are within the range between 0.1% and 10% and polymerization degrees of the PVA are within the range between 1000 and 4000. If the densities of the PVA are higher than 10%, the viscosities of the PVA coating liquids 14 are too high and the stable coating can not be performed. If the densities of the PVA is too low, the coating liquid layers easily get rough during the drying since the viscosities of the PVA coating liquids 14 are low. But, if the densities of the PVA is 0.1% or higher, enough gelation for preventing the coating liquid layers from getting rough during the drying is possible on the condition that the polymerization degrees of PVA are within the range between 1000 and 4000, preferably within the range between 1000 and 3000. The PVA used in the present invention is polyvinyl alcohol polymer. The PVA is generated by saponifying vinylester such as vinyl acetate or vinylester that is generated by polymerizing in a polymerizing method such as bulk polymerization, emulsion polymerization, solution polymerization and suspension polymerization or copolymerizing vinylester with copolymerized monomer. The saponification rate of the PVA is within the range between 60% and 100%, favorably within the range between 70% and 99.5%.

In case the web 12 is coated with the multiple PVA coating liquids 14 containing the PVA, the layers do not get rough easily during the drying if the density of at least one of the layers is 50 mPa·s or higher. In this case, the density needs to be 300 mPa·s or lower not to hinder the stable coating.

Next, the coating apparatus 10 coats the web 12 with the prepared PVA coating liquids 14 to form the coating liquid layers on the web 12. The temperature of the coating liquids at the coating is within the range between 20° C. and 40° C. The temperature of the coating liquids needs to be 20° C. or higher to achieve the stable coating, and it needs to be 40° C. or lower in case of a heat-sensitive recording material that receives a bad influence from high temperature.

Then, the light wind drying device 3 preliminarily dries the web 12 on which the coating liquid layers are formed under the above-described coating liquid temperature conditions. As described-above, while the web 12 passes through the body 3A, the temperature of the coating liquid layers on the web 12 needs to be maintained at the temperature that is 3° C. lower than that of the coating liquids when the coating apparatus 10 coats the web 12 with the coating liquids or lower for three seconds or more. The layer temperature is preferably maintained at the temperature that is 3° C. lower than that of the coating liquids or lower for five seconds or more, more preferably for ten seconds or more. In this case, the cold wind whose dew point is 15° C. or lower flows onto the coating liquid layers on the web 12 at the speed of 1–8 m/sec. The cold wind whose dew point is 10° C. or lower flows at the speed of 3–6 m/sec.

After that, the strong wind drying device 4 finally dries the coating liquid layers with of the warm wind whose temperature is within the range between 25° C. and 40° C. to form the coating layers on the web 12, and the winding device 5 winds the web 12.

In the method of forming the coating layers according to the present invention, the adding conditions of the polymer polysaccharide and the metal ions for the PVA coating liquids 14, the amounts of the coated PVA, the polymerization degrees of the PVA, the temperature of the coating liquids at the coating and the preliminary drying conditions for drying the coating liquid layers are appropriately determined, and thus both the stable coating and the uniform drying can be achieved. Therefore, the coating liquid layers that are not rough and have uniform thicknesses can be formed, and the quality of the product can be improved.

The web 12 used in the present invention may be made of paper, resin film such as polyethylene film, metal foil, or the like.

EMBODIMENTS

The coating and drying line 1 in FIG. 1 formed coating layers in three embodiments that satisfied the conditions of the method of forming the coating layers according to the present invention and seven references that did not satisfy the conditions, and whether the formed layers were good or bad and the qualities of the products were examined.

Table 1 shows coating conditions, drying conditions and PVA coating liquid conditions.

TABLE 1

| Items | | Contents |
|---|---|---|
| Coating conditions | | Slide-hopper-type coating apparatus formed two layers at one time<br>Coating speed (running speed of web) was 100 m/min<br>Thicknesses of top layer and bottom layer of wet coating liquid layers were 40 μm and 60 μm (100 μm in total)<br>Temperatures of coating apparatus and coating liquids were 28° C. |
| Web | | PET film with thickness of 0.1 mm |
| Drying conditions | A | Cold wind whose temperature was 17° C. and humidity was 40% (dew point 10° C.) flew onto layers for 20 seconds in preliminary drying<br>Warm wind whose temperature was 35° C. and humidity was 25% flew onto layers for 180 seconds in final drying |
| | B | Cold wind whose temperature was 17° C. and humidity was 40% (dew point 10° C.) flew onto layers for 2 seconds in preliminary drying<br>Warm wind whose temperature was 35° C. and humidity was 25% flew onto layers for 180 seconds in final drying |
| | C | Cold wind whose temperature was 23° C. and humidity was 50% (dew point 17° C.) flew onto layers for 20 seconds in preliminary drying<br>Warm wind whose temperature was 35° C. and humidity was 25% flew onto layers for 180 seconds in final drying |
| Coating liquid conditions<br>Top layer was protection layer<br>Bottom layer was coloring layer | A | Top layer: solution in which PVA217 was dissolved and colloidal silica was dispersed (PVA density was 3%)<br>Bottom layer: solution in which PVA217 was dissolved and heat sensitizing agent (coloring agent and developing agent) was dispersed (PVA density was 4%) |
| | B | Top layer: solution in which PVA205 was dissolved and colloidal silica and pigment were dispersed (PVA density was 3%)<br>Bottom layer: solution in which PVA205 was dissolved and heat sensitizing agent (coloring agent and developing agent) was dispersed (PVA density was 4%) |
| | C | Top layer: solution in which PVA217 was dissolved and |

TABLE 1-continued

| Items | Contents |
|---|---|
| | colloidal silica was dispersed (PVA density was 2.5%) Bottom layer: solution in which PVA217 was dissolved and heat sensitizing agent (coloring agent and developing agent) was dispersed (PVA density was 3%) |

(Notes)

① Every type of PVA was made by Kuraray Co., Ltd.; and the polymerization degree of PVA217 was 1700 and the polymerization degree of PVA205 was 500.

② Potassium sulfate was uses as salt with metal ions.

③ κ-carrageenan made by Taito Co., Ltd. was used as polymer polysaccharide.

④ Densities (% by weight) of the polymer polysaccharide of the top layer and the bottom layer were the same, and adding amounts (mol/liter) of the metal ions of the top layer and the bottom layer were the same.

FIG. 4 shows conditions in the three examples and the seven references and the results of them. The conditions of them were set in such a way that the coating conditions, the drying conditions and the PVA coating liquid conditions in FIG. 1 were combined so that the examples satisfied the conditions of the method of forming the coating layers according to the present invention and seven references did not satisfy the conditions.

In FIG. 4, the polysaccharide densities are densities (% by weight) with respect to the coating liquids, and the metal ion adding amounts are how many moles of metal ions were added with respect to a liter of the coating liquids, and the viscosities are values when the shearing speed was 50 (1/sec). The sections of the coating layers after the drying are observed with a microscope, and the surfaces of the layers and the interfaces between the layers are evaluated with eyes.

In embodiments (1), (2) and (3) in which the PVA coating liquid conditions that are the adding amount of the polysaccharide, the adding amount of the metal ions, the viscosities of the top layer and the bottom layer and the temperature of the coating liquids at the coating and the drying conditions satisfied the conditions of the present conditions, two fine layers were formed and satisfactory results could be gotten with respect to the forming of the coating layers after the drying, coloring sensitivities, weatherabilities and qualities of the products.

In the embodiments (2) and (3) in which the metal ions as well as the polymer polysaccharide were added as the addition agent, better results were gotten with respect to the forming of the coating layers after the drying than the result in the embodiment (1) in which the metal ions were not added.

Meanwhile, in references (1)–(7) that did not satisfy the conditions of the present invention, the forming of the coating liquid layers, the forming of the coating layers after the drying, the coloring sensitivities, and the weatherabilities, especially the forming of the coating layers after the drying were bad, and the qualities of the products were bad too.

The reference (1) in which the cold wind whose temperature was 17° C. and humidity was 40% (dew point 10° C.) flew onto the layers for 2 seconds in the preliminary drying and a warm wind whose temperature was 35° C. and humidity was 25% flew onto the layers for 180 seconds in the final drying did not satisfy the preliminary drying conditions of the present invention that the layer temperature of the coating liquid layers was maintained at the temperature that was 3° C. lower than that of the coating liquids or lower for three seconds or more. In this case, the low-temperature gelation did not occur, and thus the layers after the drying were very rough, and the coloring sensitivities and the weatherabilities were poor.

In the reference (2), the density of the added polymer polysaccharide was 0.04% that was lower than 0.05%, the lower limit of the density of the addition agent of the present invention. In this case, the layers after the drying were very rough since the low-temperature gelation was not enough even though the stable coating was performed, and the coloring sensitivities and the weatherabilities were poor.

In the references (3) and (4), the adding amount of the polymer polysaccharide or the metal ions were too high and higher than the upper limit of the adding amount of the present invention. In this case, the viscosities of the coating liquids were high and the gelation partly occurred and the viscosities were unstable, and thus the stable coating could not be performed and coating unevenness occurred. Therefore, the forming of the coating layers after the drying, the coloring sensitivities and the weatherabilities could not be evaluated.

In the reference (5), the dew point of the cold wind at the preliminary drying was 17° C. that was higher than 15° C., the upper limit of the dew point of the cold wind of the present invention. In this case, the temperature of the coating liquid layers did not fall enough for gelation and the interface between the two layers was rough after the drying. The coloring sensitivity was good, but the weatherability was not good.

In the reference (6), the polymerization degree of PVA 205 included in the PVA coating liquids was 500 that is not within the range between 1000 and 4000 of the polymerization degree condition of the present invention. In this case, the polymerization degree of PVA was too low and the gelation was not enough, and thus the layers easily got rough after the drying.

The reference (7) in which the viscosity of the top layer was 35 mPa·s and the viscosity of the bottom layer was 40 mPa·s at the temperature of the coating liquids at the coating did not satisfy the condition of the present invention that the viscosity of at least one layer of the layers at the temperature of the coating liquids was 50 mPa·s or higher. In this case, the viscosities of the were not high enough, and the layers easily got rough after the drying in the same way as in the reference (6).

As set forth hereinabove, according to the method of forming the coating layers of the present invention, the stable coating and the uniform drying of the PVA coating liquids can be performed and the coating layers that is not rough and has the uniform thickness can be formed. Therefore, the products of high quality, especially heat-sensitive recording paper of high quality can be produced, and the productivity can be improved since the number of inferior products can be reduced.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of forming a coating layer where a running web is coated with a PVA coating liquid containing polyvinyl alcohol and a coating liquid layer on said running web is dried to form the coating layer on said running web, the method comprising the steps of:

adding polymer polysaccharide to said PVA coating liquid so that a density of the polymer polysaccharide is within the range between 0.05% and 0.5% by weight with respect to said PVA coating liquid;

forming the coating liquid layer on said running web by coating said running web with said PVA coating liquid to which the polymer polysaccharide is added so that a temperature of said PVA coating liquid is within the range between 20° C. and 40° C. at the coating; and drying the coating liquid layer after preliminarily drying the coating liquid layer on said running web so that a temperature of the coating liquid layer is maintained for at least three seconds at a temperature that is lower than the temperature of said PVA coating liquid by at least 3° C.

2. The method of forming the coating layer as defined in claim 1, wherein a drying wind whose dew point is at most 15° C. flows onto the coating liquid layer at a speed within the range between 1 m/sec and 8 m/sec during the preliminary coating.

3. The method of forming the coating layer as defined in claim 1, wherein a density of the polyvinyl alcohol contained in said PVA coating liquid is within the range between 0.1% and 10% by weight and a polymerization degree of the polyvinyl alcohol is within the range between 1000 and 4000.

4. The method of forming the coating layer as defined in claim 1, wherein metal ions are added to said PVA coating liquid so that at most 0.02 mol of the metal ions is added with respect to a liter of said PVA coating liquid.

5. The method of forming the coating layer as defined in claim 1, wherein the method of forming the coating layer is a method of producing one of heat-sensitive recording paper and pressure-sensitive recording paper.

6. A method of forming coating layers where a running web is coated with multiple PVA coating liquids containing polyvinyl alcohol and coating liquid layers on said running web are dried to form the coating layers on said running web, the method comprising the steps of:

adding polymer polysaccharide to said PVA coating liquids so that densities of the polymer polysaccharide are within the range between 0.05% and 0.5% by weight with respect to said PVA coating liquids;

forming the coating liquid layers on said running web by coating said running web with said PVA coating liquids to which the polymer polysaccharide is added so that a temperature of said PVA coating liquids is within the range between 20° C. and 40° C. at the coating; and drying the coating liquid layers after preliminarily drying the coating liquid layers on said running web so that a temperature of the coating liquid layers is maintained for at least three seconds at a temperature that is lower than the temperature of said PVA coating liquids by at least 3° C.

7. The method of forming the coating layers as defined in claim 6, wherein a drying wind whose dew point is at most 15° C. flows onto the coating liquid layers at a speed within the range between 1 m/sec and 8 m/sec during the preliminary coating.

8. The method of forming the coating layers as defined in claim 6, wherein densities of the polyvinyl alcohol contained in said PVA coating liquids are within the range between 0.1% and 10% by weight and a polymerization degree of the polyvinyl alcohol is within the range between 1000 and 4000.

9. The method of forming the coating layers as defined in claim 6, wherein metal ions are added to said PVA coating liquids so that at most 0.02 mol of the metal ions is added with respect to a liter of said PVA coating liquids.

10. The method of forming the coating layers as defined in claim 6, wherein a viscosity of at least one layer of the coating liquid layers is within the range between 5 mPa·s and 300 mPa·s at the temperature of said PVA coating liquids.

11. The method of forming the coating layers as defined in claim 6, wherein the method of forming the coating layers is a method of producing one of heat-sensitive recording paper and pressure-sensitive recording paper.

* * * * *